US010653230B1

(12) United States Patent
Wang

(10) Patent No.: US 10,653,230 B1
(45) Date of Patent: May 19, 2020

(54) CONVERTIBLE BACKPACK

(71) Applicant: Roffe Accessories, Inc., New York, NY (US)

(72) Inventor: Zhifeng Wang, Quanzhou (CN)

(73) Assignee: ROFFE ACCESSORIES, INC., New York, NY (US)

( * ) Notice: Subject to any disclaimer, the term of this patent is extended or adjusted under 35 U.S.C. 154(b) by 10 days.

(21) Appl. No.: 16/254,729

(22) Filed: Jan. 23, 2019

(51) Int. Cl.

| | |
|---|---|
| ***A45C 7/00*** | (2006.01) |
| ***A45C 3/00*** | (2006.01) |
| ***A45F 3/04*** | (2006.01) |
| ***A45C 9/00*** | (2006.01) |
| ***A45C 13/10*** | (2006.01) |
| *A45F 3/00* | (2006.01) |

(52) U.S. Cl.
CPC ..... *A45F 3/047* (2013.01); *A45C 7/0095* (2013.01); *A45C 9/00* (2013.01); *A45C 13/103* (2013.01); *A45C 7/0068* (2013.01); *A45C 2009/007* (2013.01); *A45F 3/04* (2013.01); *A45F 2003/003* (2013.01)

(58) Field of Classification Search
CPC ..... A45F 3/04; A45C 7/00; A45C 7/0095; A45C 7/0063; A45C 7/0068; A45C 13/103
USPC ..... 224/581, 627, 645, 653; 190/103; D3/216
See application file for complete search history.

(56) References Cited

U.S. PATENT DOCUMENTS

| | | | | |
|---|---|---|---|---|
| 3,443,671 A * | 5/1969 | Dyke | A45C 7/0027 | 190/103 |
| 4,830,154 A * | 5/1989 | Gerch | A45C 3/00 | 190/103 |
| 4,901,897 A * | 2/1990 | Briggs | A45C 3/004 | 206/287.1 |
| 5,431,265 A * | 7/1995 | Yoo | A45C 3/00 | 190/103 |
| 5,544,792 A * | 8/1996 | Arnwine | A45C 7/0086 | 224/153 |
| 5,676,296 A * | 10/1997 | Masters | A45C 3/001 | 224/148.7 |
| 6,000,509 A * | 12/1999 | Chisholm | A45C 13/02 | 150/113 |
| 6,183,133 B1 * | 2/2001 | Roegner | A45C 3/00 | 150/113 |
| 6,244,481 B1 * | 6/2001 | Brougher | A45F 4/02 | 224/153 |

(Continued)

*Primary Examiner* — Justin M Larson
(74) *Attorney, Agent, or Firm* — Gottlieb, Rackman & Reisman, P.C.

(57) ABSTRACT

A portable container includes a first storage component and a second storage component with each of the first and second storage components having a body with a plurality of sides for defining a periphery. The first and second storage components are connected to each other along one of their sides such that they are pivotally rotatable with respect to one another. A first elongated connector extends along at least a portion of the remaining sides of the first storage component. A second elongated connector extends along at least a portion of the remaining sides of the second storage component and is configured to be selectively matingly engaged with the first elongated connector. At least one of the first and second storage components includes an adjustable storage space.

19 Claims, 9 Drawing Sheets

(56) References Cited

U.S. PATENT DOCUMENTS 6,305,587 B1 * 10/2001 Miller ..... A45C 7/0068 224/153
6,328,146 B1 * 12/2001 Siwak ..... A45C 3/00 150/106
6,558,062 B1 * 5/2003 Wyant ..... A45C 7/0068 206/425
6,591,950 B1 * 7/2003 Scicluna ..... A45C 7/0027 190/103
6,595,334 B1 * 7/2003 Saetia ..... A45C 5/143 190/102
6,609,598 B2 * 8/2003 Hsu ..... A45C 7/0027 190/103
6,655,565 B2 * 12/2003 Godshaw ..... A45F 3/04 224/576
6,742,636 B2 * 6/2004 Godshaw ..... A45C 5/06 190/102
7,191,925 B2 * 3/2007 Aris ..... A45C 9/00 224/581
7,281,616 B2 * 10/2007 Peterson ..... A45C 7/0031 190/103
D568,047 S * 5/2008 Brancky ..... D3/284
D605,397 S * 12/2009 Shor ..... D3/216
7,641,030 B2 * 1/2010 Selvi ..... A45C 7/0027 190/40
7,703,646 B2 * 4/2010 Chen ..... A45C 7/0068 190/18 A
D648,938 S * 11/2011 Meersschaert ..... D3/279
8,272,505 B2 * 9/2012 Melamed ..... A45C 7/0068 150/113
8,820,596 B1 * 9/2014 Bergquist ..... A45F 4/02 224/153
9,717,322 B1 * 8/2017 Bergquist ..... A45C 3/004
10,111,514 B2 * 10/2018 King ..... A45F 3/04
10,463,124 B2 * 11/2019 Richards ..... A45C 9/00
2004/0094583 A1 * 5/2004 Bernbaum ..... A45C 9/00 224/153
2007/0017947 A1 * 1/2007 Fenton ..... A45C 7/0063 224/650
2007/0175941 A1 * 8/2007 Berry ..... A45C 7/0077 224/583
2007/0267262 A1 * 11/2007 Sederoff ..... A45C 5/14 190/103
2010/0072235 A1 * 3/2010 Barton ..... A45C 5/14 224/153
2011/0272231 A1 * 11/2011 Hoberman ..... A45C 1/02 190/103
2012/0160626 A1 * 6/2012 Yang ..... A45C 5/02 190/18 A
2013/0020160 A1 * 1/2013 Mangano ..... A45C 5/14 190/18 A
2014/0027224 A1 * 1/2014 Lai ..... A45C 5/14 190/111
2015/0034440 A1 * 2/2015 Lai ..... A45C 7/0027 190/103
2016/0015157 A1 * 1/2016 Nouri ..... A45F 3/16 224/148.2
2019/0000203 A1 * 1/2019 Gregory ..... A45C 13/02

* cited by examiner

CONVERTIBLE BACKPACK

TECHNICAL FIELD

The present invention relates to a backpack, and more particularly, to a backpack that can be converted into luggage.

DISCUSSION OF THE RELATED ART

In the past, the variety of storage containers suitable for traveling needs was limited. For example, wooden suitcases were used for carrying small and light items, saddlebags were configured to be loaded on an animal's back and large wooden containers were used to carry large and heavy items. In recent times, there are plenty of options for storage containers to use on the go.

Carry-on luggage is popular among modern-day travelers due to the fact that it is typically sized to fit into an airplane overhead storage compartment and is generally provided with wheels and a telescopic handle for ease of carrying. Carry-on luggage is typically either soft-shelled or hard-shelled.

Hard-shelled luggage is typically provided in two mirroring halves that can be opened like a book and closed with a zipper. While they offer the outmost protection for the contents inside, hard-shelled luggage occupies a large amount of space, whether empty or full, and tends to be heavy due to its reinforced walls.

Soft-shelled luggage generally has a semi-rigid shell that can resist some degree of compression, tension and/or torsion. Thus, unless heavily compressed from the outside, it will generally occupy the same amount of space, whether empty or full. In addition, whether empty or full, carry on luggage is generally too heavy to be carried on one's back or hands, and must be pushed/pulled to its destination.

Backpacks are popular among travelers due to the fact that they can be strapped to one's back, thus freeing one's hands. Despite their convenience, backpacks have drawbacks. For example, their storage capacity is limited due to the fact that they are intended to be carried on the user's back. When manufactured to carry heavy loads, they become large and heavy, thus unappealing for daily use.

Accordingly, it would be desirable to provide an improved backpack design that can function as luggage for travel purposes.

SUMMARY

In an exemplary embodiment, a portable container includes a first storage component and a second storage component with each of the first and second storage components having a body with a plurality of sides for defining a periphery. The first and second storage components are connected to each other along one of their sides such that they are pivotally rotatable with respect to one another. A first elongated connector extends along at least a portion of the remaining sides of the first storage component. A second elongated connector extends along at least a portion of the remaining sides of the second storage component and is configured to be selectively matingly engaged with the first elongated connector. At least one of the first and second storage components includes an adjustable storage space.

In an exemplary embodiment, a backpack includes a first storage component including a first storage compartment having a volume and a second storage compartment having a volume. The first storage compartment includes a first panel, a second panel and a first flexible member extending between the first and second panels and defined by one or more sides. The first flexible member connects the first panel to the second panel to selectively adjust the volume of the first storage compartment by collapsing or expanding the one or more sides.

The second storage compartment includes a third panel, the second panel being disposed between the first and third panels, and the first and third panels are respectively configured to provide access to the first and second storage compartments.

A second storage component includes a fourth panel, a fifth panel and a second flexible member extending between the fourth and fifth panels and defined by one or more sides. The second flexible member connects the fourth panel to the fifth panel to selectively adjust the volume of the second storage component by collapsing or expanding the one or more sides. The fourth panel is configured to provide access to the second storage component.

A flexible connecting member is connected between the first storage component and the second storage component to pivotally connect the first and second storage components to each other.

A first elongated connector extends along at least a portion of the first panel of the first storage component. A second elongated connector extends along at least a portion of the second storage component and is configured to be selectively coupled to the first elongated connector, the first and second elongated connectors being configured to selectively couple the first and second storage components to each other.

A third elongated connector extends along one of the first flexible member and the first panel. A fourth elongated connector extends along one of the first flexible member and the second panel and is configured to be selectively coupled to the third elongated connector for maintaining the first flexible member collapsed or to be selectively uncoupled from the third elongated connector for allowing the first flexible member to be expanded.

A fifth elongated connector extends along one of the second flexible member and the fourth panel. A sixth elongated connector extends along one of the second flexible member and the fifth panel and is configured to be selectively coupled to the fifth elongated connector for maintaining of the second flexible member collapsed or to be selectively uncoupled from the fifth elongated connector for allowing the second flexible member to be expanded.

Accordingly, it is an object of the present invention to provide an improved backpack that can be converted to and function as luggage for travel purposes.

BRIEF DESCRIPTION OF THE DRAWINGS

The above and other features of the present invention will become more apparent by describing in detail exemplary embodiments thereof in conjunction with the accompanying drawings, in which.

DETAILED DESCRIPTION OF THE EMBODIMENTS

Figure 1:
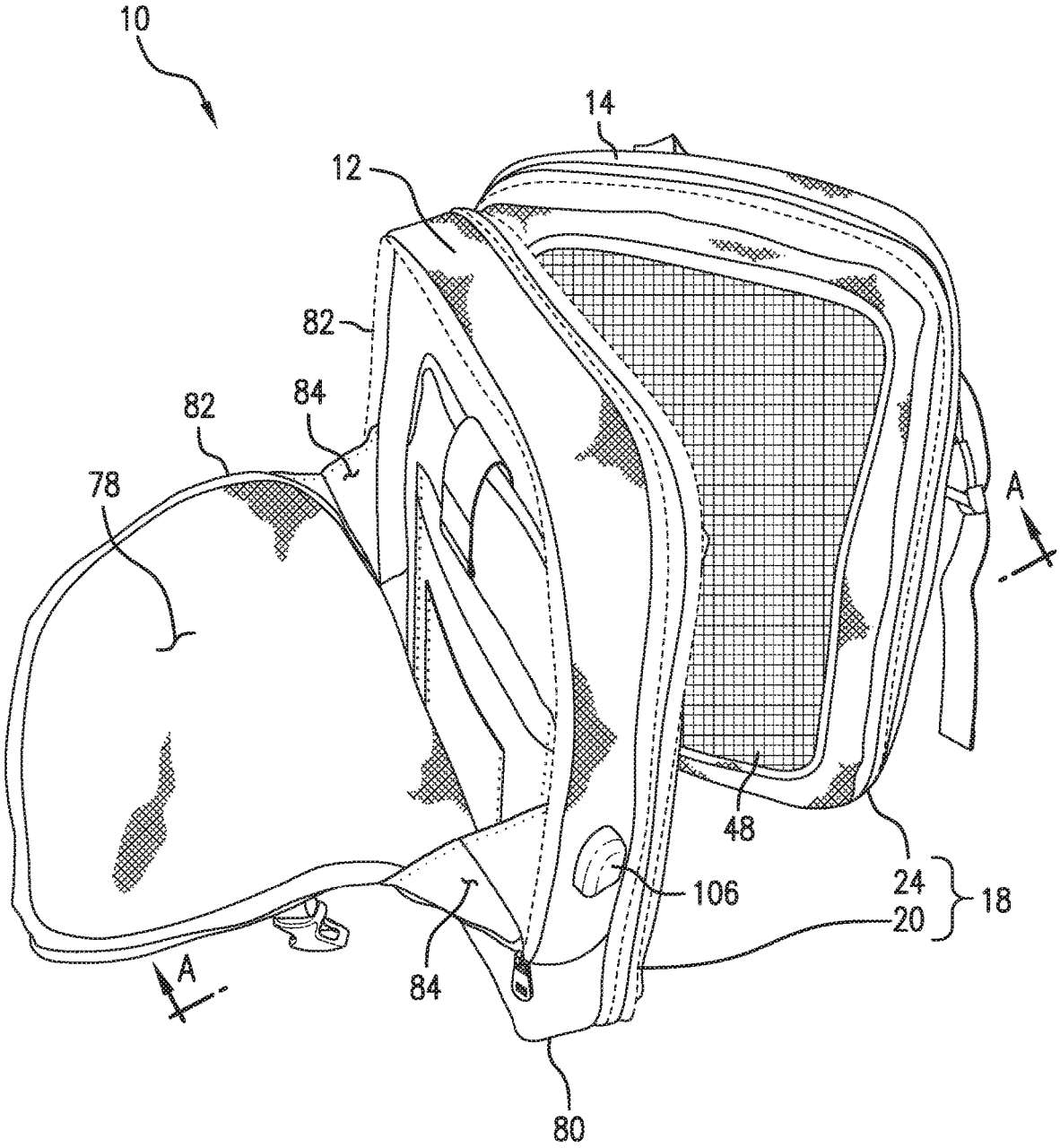
FIG. 1 is a perspective view illustrating a backpack assembly according to an exemplary embodiment of the present invention.

Exemplary embodiments of the present invention will be described more fully hereinafter with reference to the accompanying drawings. The present invention may, however, be embodied in different forms and should not be construed as limited to the embodiments set forth herein. Like reference numerals may refer to like elements throughout the specification. The sizes or proportions of elements illustrated in the drawings may be exaggerated for clarity. When an element is described to be connected or attached to another element, intervening elements may be attached/connected therebetween unless the context clearly indicates otherwise.

A backpack can be provided with two linked storage components. The linked components can be secured to each other by a zipper. The linked storage components have expandable sides made of a thin, durable and lightweight fabric for ease of folding, durability and to occupy little space when folded. At least one of the linked storage components can have more than one storage compartment, and at least one of the storage compartments is accessible from a front side of the backpack.

FIGS. 1-9 illustrate a backpack according to an exemplary embodiment of the present invention.

Figure 2:
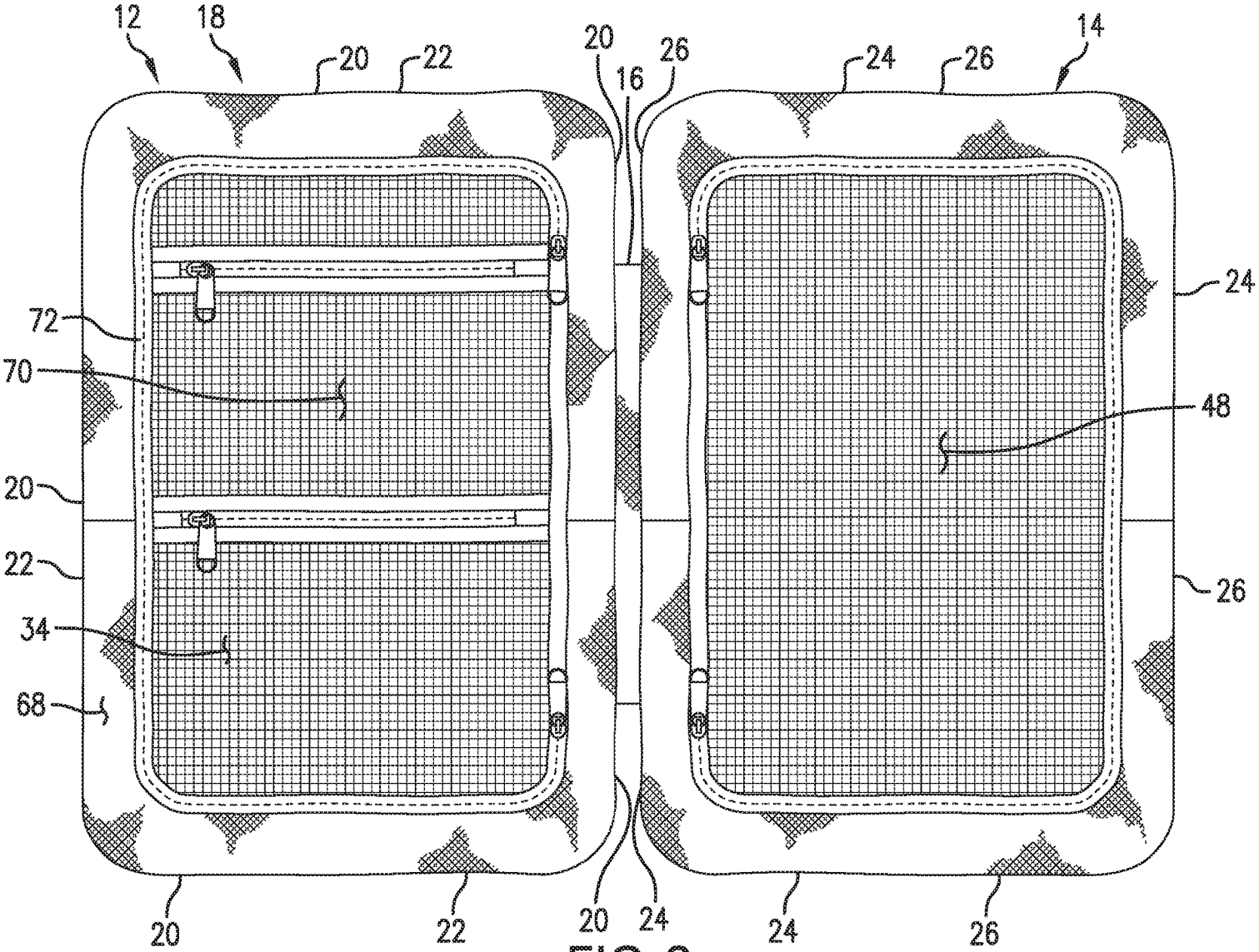
FIG. 2 is a top plan view illustrating the backpack assembly of FIG. 1 in an open state according to an exemplary embodiment of the present invention.

Referring to FIGS. 1 and 2, a backpack 10 includes a storage component 12 and a storage component 14 joined by a flexible connecting member 16. The first and second components 12 and 14 are configured to be selectively closed together by using an elongated connector 18. The flexible connecting member 16 may be a flexible fabric including, for example, nylon, polyester, leather, artificial leather (e.g., vinyl), and the like. The elongated connector 18 may be a zipper or other elongated fastener that can be used to selectively join and close two elements to each other along the fastener's length.

In an embodiment, although not shown in the drawings, the flexible connecting member 16 may be omitted and the first and second components 12 and 14 may be directly attached to each other by seams or other attachment mechanisms along a portion of their respective outer peripheries.

The elongated connector 18 and other elongated connectors included in the backpack 10 may be referred to as zippers (e.g., zipper 18, 38, 52, 82, etc.,) in the remainder of the specification for convenience of description. However, it is understood that such elongated members are not limited to being zippers, and can be fasteners of any type that may be used to selectively join and attach two elements to each other along the fastener's length. Examples include wire and hook fasteners, string and hook fasteners, hook and loop fasteners, etc.

Referring again to FIGS. 1 and 2, the zipper 18 may have a first strip 20 attached to an edge 22 of the first component 12 and a second strip 24 attached to an edge 26 of the second component 14. When the zipper 18 is opened, the first and second components 12 and 14 may be turned away or pivoted from each other about the connecting member 16 in order to provide access to the first and second components 12 and 14, and may be turned or pivoted toward each other about the connecting member 16 in order to close the first and second components 12 and 14.

Figure 3:
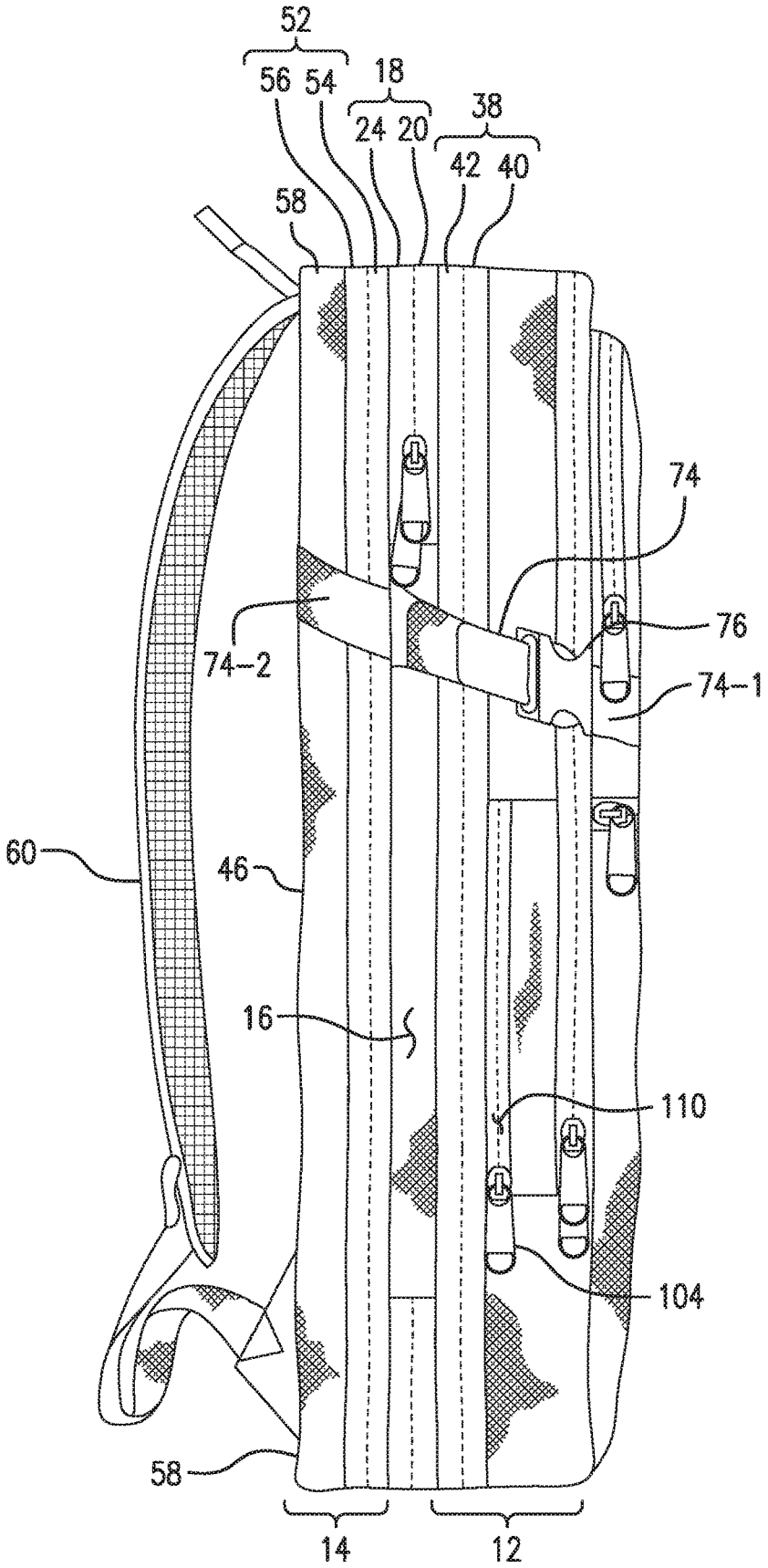
FIG. 3 is a side elevational view illustrating a first side of the backpack assembly of FIG. 1 in a collapsed state according to an exemplary embodiment of the present invention.
Figure 4:
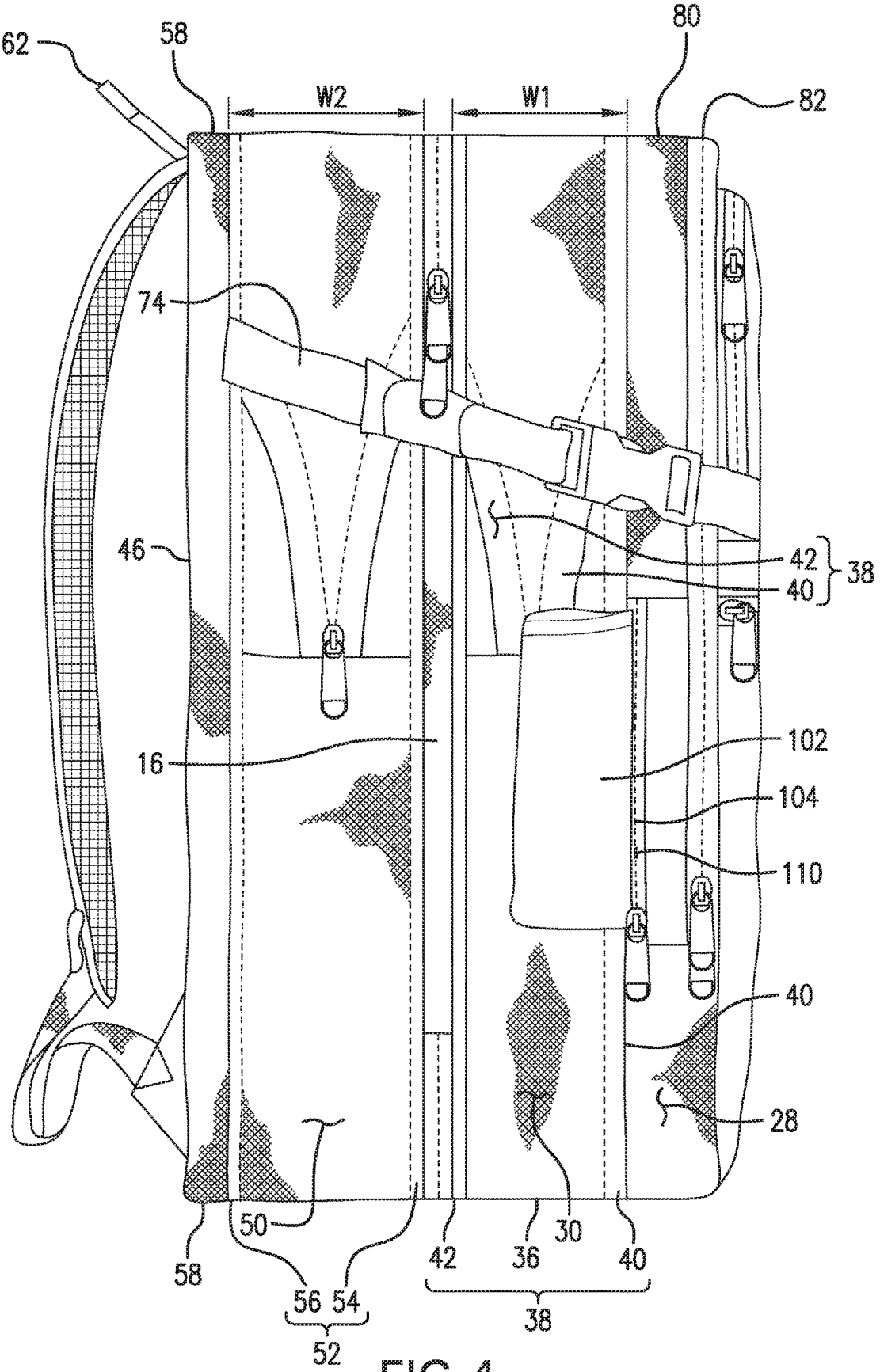
FIG. 4 is a side elevational view illustrating the first side of the backpack assembly of FIG. 1 in an expanded state according to an exemplary embodiment of the present invention.
Figure 5:
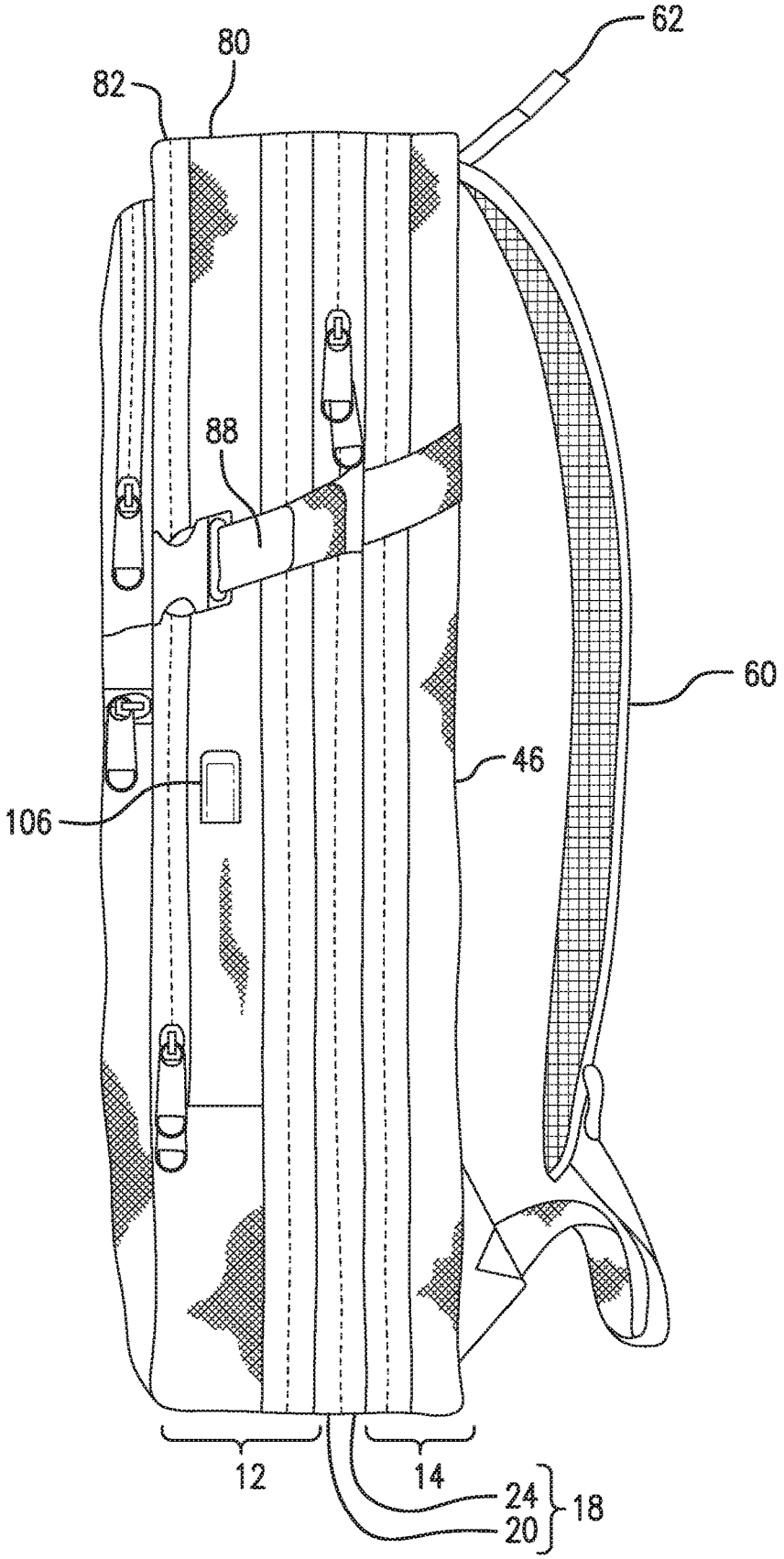
FIG. 5 is a side elevational view illustrating a second side of the backpack assembly of FIG. 1 in a collapsed state according to an exemplary embodiment of the present invention.

The first and second components 12 and 14 may be joined to each other along their respective edges 22 and 26 and may be secured in the closed position by closing the zipper 18 in a conventional fashion, as shown in FIGS. 3-5.

As shown with reference to FIGS. 3 and 5, the zipper 18 may loop around the backpack 10 and may be connected to both ends of the connecting member 16. Thus, an enclosed space may be formed between the first and second portions 12 and 18 when the zipper 18 is closed. When the backpack 10 has four sides and four rounded corners as shown in FIGS. 1-9, the zipper 18 may extend along all four sides and rounded corners, although partially on the side where the flexible connecting member 16 is disposed, to enable the first and second components 12 and 14 to be opened like a book, or to be turned by at least 180 degrees with respect to each other.

Figure 6:
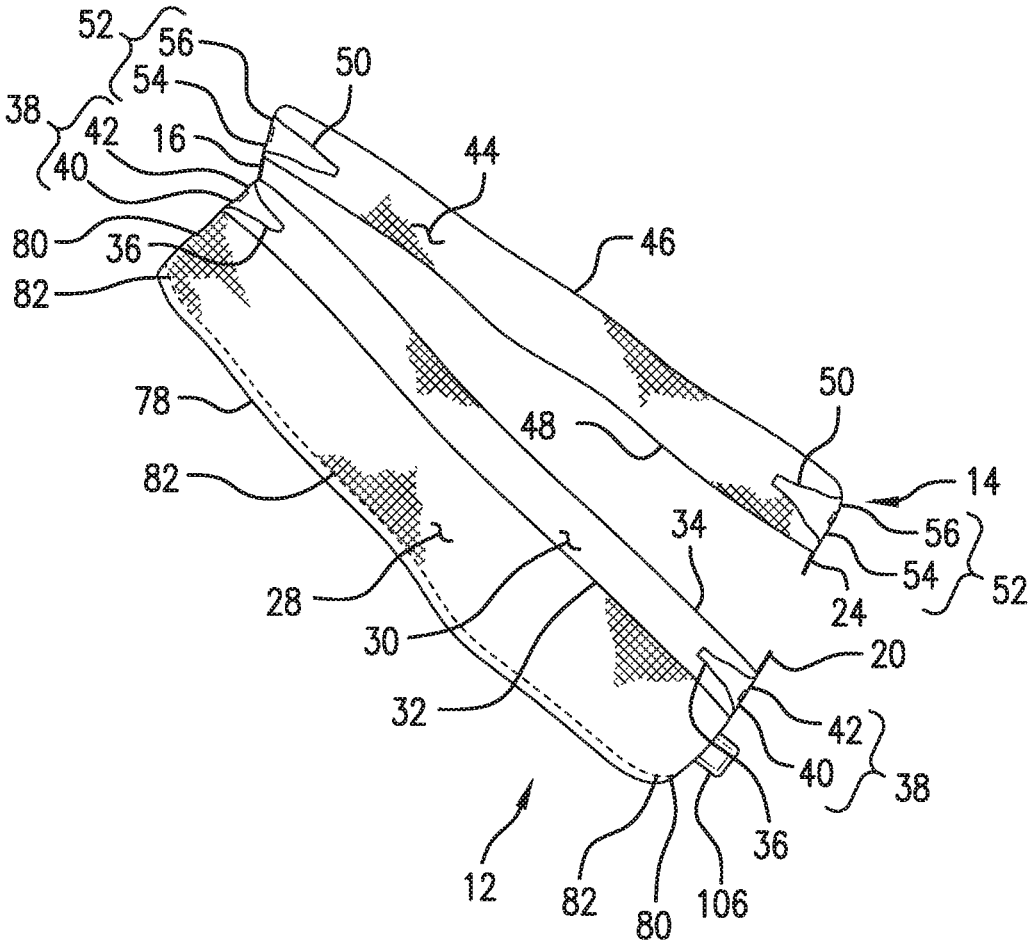
FIG. 6 is a cross-sectional view taken along the line A-A of FIG. 1.

Referring now to FIG. 6, the first component 12 may include a first compartment 28 and a second compartment 30 for storing items therein. The first and second compartments 28 and 30 may be separated from each other by a panel 32.

Referring to FIG. 6, the second compartment 30 of the first component 12 is adjustable, and is configured to be expanded and collapsed as needed to accommodate a user's storage needs. Referring again to FIG. 6 the second compartment 30 may be defined by the panel 32 on its rear, a panel 34 on its front, and an adjustable and flexible member 36 connected to the panels 32 and 34 all around. For example, the flexible member 36 may extend between the panels 32 and 34, and may be connected all around an outer periphery of the panel 32 and all around an outer periphery of the panel 34. In an embodiment, there are no extension portions connected between the flexible member 36 and the panels 32 and 34.

The backpack 10 may have various shapes. In FIGS. 1-9 the backpack 10 is shown as having a rectangular shape with rounded corners. However, the backpack 10 may also other shapes, for example, a round, oval, elliptical, square, rectangular or other polygonal shape, or a combination thereof.

As shown in FIGS. 2 and 6, the panels 34 may have a shape corresponding to the shape of the backpack 10. As shown in FIG. 6, the panel 32 may also have a shape corresponding to the shape of the backpack 10. Each of the panels 32 and 34 may include at least one thin sheet of durable fabric including nylon, polyester, Kevlar, polyamide, and the like. The thin fabric sheets may be woven, knit, etc., and may have perforations, a mesh-like structure, or a plain sheet structure. Alternatively, or in addition, the panels 32 and 34 may include leather, artificial leather, etc. Each of the panels 32 and 34 may be padded or unpadded. In addition, each of the panels 32 and 34 may include a plurality of thin fabric sheets stacked on each other, and/or a semi-rigid board that is flexible but can maintain its own shape when resting on a surface and when loaded to a certain degree.

In an embodiment, the panels 32 and 34 include one or more thin fabric sheets and no padding to reduce the weight of the backpack 10.

When the backpack 10 has a rectangular shape with rounded corners as shown in FIGS. 1-9, the flexible member 36 has four sides and four rounded corner portions, linking the panels 32 and 34 all around as described above. FIG. 4 illustrates one of the sides of the flexible member 36 in an expanded state.

The flexible member 36 is the component that permits the second compartment 30 to be adjustable between a collapsed state, as shown in FIGS. 1, 3 and 5, and an expanded state, as shown in FIG. 4.

The flexible member 36 can be folded between the panels 32 and 34 as shown in FIG. 6 to collapse the second compartment 30, as shown in FIGS. 3 and 5. Thus, the backpack 10 can have a slim design when expansion of the second compartment 30 is not needed. As a result, the backpack 10 may be highly portable, slim, and may be used daily for carrying personal items, sparing the user the inconvenience of having to use a large and heavy bag. In addition, the backpack 10 may occupy little space when stored between uses when the second compartment 30 is collapsed.

The flexible member 36 may be made of a durable, thin, lightweight and flexible material to reduce the weight of the backpack 10, to be easily folded as shown in FIG. 6 in order to collapse the second compartment 30, and to be easily unfolded to expand the second compartment 30 as shown in FIG. 4. For example, the flexible member 36 may include a thin sheet of fabric including nylon, polyester, Kevlar, polyamide, and the like. Alternatively, or in addition, the flexible member 36 may include leather, artificial leather, etc.

Although not shown in the drawings, the flexible member 36 may also include a plurality of fabric sheets stacked on each other for increased durability. The stacked fabric sheets may be made of the same material as each other or of different materials. The flexible member 36 may be padded on unpadded. In an embodiment, the flexible member 36 is unpadded to reduce the weight of the backpack 10 and to be easily folded/collapsed and expanded as needed.

FIG. 4 illustrates the flexible member 36 in an expanded state, corresponding to the expanded state of the second compartment 30. In the expanded state, the flexible member 36 has a predetermined width w1. The width w1 may be set based on design criteria including a desired volume, weight capacity, etc. of the second compartment 30. Thus, the backpack 10 is expandable and may be used to store and carry large items that would not otherwise fit into a slim backpack. Accordingly, the backpack 10 may be used to spare the user from the inconvenience of having to carry an additional bag/luggage when traveling. The expandable feature of the inventive backpack is important to a user needing a small and light backpack with a small width for everyday use, but that can also be expanded when needed to carry large items.

Size, weight and adjustability of storage volume are important factors to users of backpacks since a backpack is usually carried on the back. A large, non-adjustable bag can always be used, but such bags are not portable and are inconvenient for daily use due to their size and their own weight.

The adjustable backpack 10 offers a large storage capacity when needed through its lightweight, durable and adjustable sides (e.g., the collapsible and expandable sides of the flexible member 36, see FIGS. 3, 4 and 6), which can be folded/collapsed to form a narrow, light and strong backpack for everyday use.

As shown in FIGS. 3 and 6, a zipper 38 may be used to maintain the second compartment 30 secure in the collapsed state and to allow the flexible member 36 to be expanded when needed, thus expanding the second compartment 30.

For example, when the zipper 38 is opened, the flexible member 36 may be expanded, as shown in FIG. 4, and collapsed, as shown in FIGS. 3, 5 and 6, to expand and collapse the second compartment 30. When the flexible member 36 is folded/collapsed, the zipper 38 can be closed to maintain the second compartment 30 in the collapsed state, thus reducing the width of the backpack 10.

Referring to FIGS. 3-4 and 6, the zipper 38 may have a first strip 40 and a second strip 42 forming a loop around the flexible member 36. The first strip 40 may be attached all around a junction between the panel 32 and a first end of the flexible member 36. Alternatively, the first strip 40 may be attached to a periphery of the panel 32 all around the first end of the flexible member 36, or all around a circumference of the flexible member 36 adjacent to or near the panel 32.

The second strip 42 may be attached all around a junction between the panel 34 and a second end of the flexible member 36. The first and second ends of the flexible member 36 are opposite to each other. Alternatively, the second strip 42 may be attached to a periphery of the panel 34 all around the second end of the flexible member 36, or all around a circumference of the flexible member 36 adjacent to or near the panel 34.

In addition, the first and second strips 40 and 42 may extend in a V-shape along a portion of the outer surface of the flexible member 36 to facilitate the closing of the zipper 38, as shown in FIG. 4. Thus, when closed, the zipper 38 may maintain the panels 32 and 34 close together to a distance of, for example, the width of the zipper 38. Thus, the backpack 10 may have a narrow width.

Referring to FIG. 6, the second component 14 of the backpack 10 may include a third compartment 44 for storing items therein. The third compartment 44 may be defined by a panel 46 on its rear, a panel 48 on its front, and an adjustable and flexible member 50 linking the panels 46 and 48 all around. For example, the flexible member 50 may extend between the panels 46 and 48, and may be connected all around an outer periphery of the panel 46 and all around an outer periphery of the panel 48.

The flexible member 50 is the component that permits the third compartment 44 to be adjustable between a collapsed state, as shown in FIGS. 3, 5 and 6, and an expanded state, as shown in FIG. 4. The flexible member 50 may include the same materials as those of the flexible member 36. Thus, a detailed description thereof is being omitted for brevity purposes.

The flexible member 50 may have a predetermined width w2 in an expanded state, as shown in FIG. 4. The widths w1 and w2 may be the same as each other or different from each other. In an embodiment, the flexible members 36 and 50 have the same width as each other.

As shown in FIG. 4, an extension part 58 can be disposed between the flexible member 50 and the panel 46, connecting the flexible member 50 with the panel 46. In an embodiment, the extension part 58 is omitted to reduce the width of the backpack 10.

Referring to FIGS. 3 and 4, a zipper 52 may be used to allow the flexible member 50 to be expanded, thus expanding the third compartment 44, and to maintain the third compartment 44 secured in its collapsed state, as needed.

As shown in FIGS. 3 and 4, when opened, the zipper 52 allows the flexible member 50 to be expanded and collapsed. When the flexible member 50 is folded/collapsed, the zipper 52 can be closed to maintain the third compartment 44 in the collapsed state, thus reducing the width of the backpack 10.

Referring to FIGS. 3-4 and 6, the zipper 52 may have a first strip 54 and a second strip 56 forming a loop around the flexible member 50. The first strip 54 may be attached all around a junction between the panel 48 and a first end of the flexible member 50. Alternatively, the first strip 54 may be attached to a periphery of the panel 48 all around the first end of the flexible member 50, or all around a circumference of the flexible member 50 adjacent to or near the panel 48.

Referring again to FIGS. 3-4 and 6, the second strip 56 may be attached all around a junction between the panel 46 and a second end of the flexible member 50. The first and second ends of the flexible member 50 are opposite to each other. Alternatively, the second strip 56 may be attached to a periphery of the panel 46 all around the second end of the flexible member 50, or all around a circumference of the flexible member 50 adjacent to or near the panel 46. The second strip 56 may be attached to the extension part 58 or to the junction between the extension part 58 and the second end of the flexible member 50 when the extension part 58 is provided.

In addition, the first and second strips 54 and 56 may extend in a V-shape along a portion of the outer surface of the flexible member 50 to facilitate the closing of the zipper 52, as shown in FIG. 4.

As shown in FIG. 3, the zippers 38, 18 and 52 may be disposed adjacent to each other to reduce the width of the backpack 10 in the collapsed state. In other words, there may be no gaps between the zippers 18 and 38, and there may be no gaps between the zippers 18 and 52.

The benefits of making the flexible members 36 and 50 from lightweight and thin but durable fabric(s) enables the flexible members 36 and 50 to be easily folded within their respective second and third compartments 30 and 44 and to occupy little space when folded. In addition, the aforementioned fabrics included in the flexible members 36 and 50 have a high resistance against tears, rips, punctures, etc., eliminating or reducing the need to have semi-rigid or inflexible (e.g., rigid) hard boards for reinforcing the sides of the backpack 10. Thus, the backpack 10 can be made light and durable.

Figure 7:
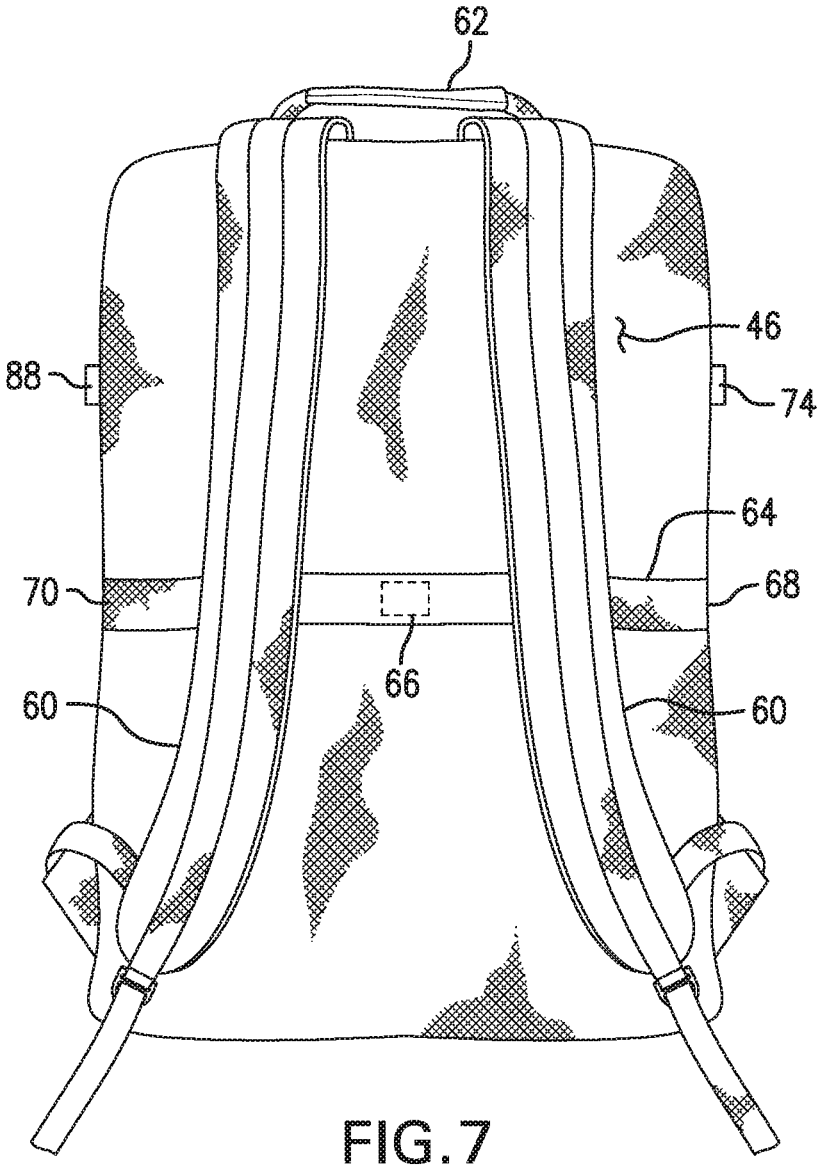
FIG. 7 is a rear elevational view illustrating a rear side of the backpack assembly of FIG. 1 according to an exemplary embodiment of the present invention.

As shown in FIGS. 4, 6 and 7, the panel 46 may have a shape corresponding to the shape of the backpack 10. As shown in FIGS. 1 and 2, the panel 48 may also have a shape corresponding to the shape of the backpack 10. Each of the panels 46 and 48 may have a structure and material composition similar to the panels 32 and 34. Thus a description thereof may be omitted for brevity.

FIG. 2 illustrates the configuration of the panels 34 and 48 according to an exemplary embodiment.

Referring to FIGS. 2 and 6, the panel 34 is used to provide access to the second compartment 30. As shown in FIG. 2, the panel 34 may include a border portion 68 looping around an outer periphery of the panel 34 and an access portion 70 for providing access to the second compartment 30 by opening a zipper 72, the zipper 72 connecting the border portion 68 and the access portion 70 to one another. In an embodiment, the border portion 68 may be omitted and the access portion 70 may be directly connected to the outer periphery of the panel 34 through the zipper 72. The zipper 72 can be closed to secure items that can be stored in the second compartment 30. The access portion 70 of the panel 34 may include a plurality of pockets, each accessible through its own respective zipper, as shown in FIG. 2. The pockets may have at least one layer of a mesh-like fabric or with perforations for reduced weight.

As shown in FIGS. 2 and 6, the panel 48 is used to provide access to the third compartment 44. The panel 48 may have a similar configuration as the panel 34, as shown in FIG. 2, but the panel 48 may omit the pockets and its window portion may consist of a single layer of a mesh-like fabric or a fabric with perforations for reduced weight.

However, it is understood that the panels 34 and 48 may be variously configured as needed. For example, the panels 34 and 48 may have one or more thin and durable fabric layers as described above, and may have a plain structure, a mesh-like structure, or perforations, and may each have pockets.

The backpack 10 of the invention also provides a convertible storage compartment between the panels 34 and 48 when the first and second components 12 and 14 are closed by the zipper 18. For example, the zipper 18 may have two sliders that can be separated from each other to form an opening therebetween, thus allowing access to the convertible storage compartment for quickly storing or removing items from the convertible storage area. In addition, the opening formed between the two sliders provides quick access to the pockets of the window portion 72, sparing the user from having to entirely open the zipper 18 and turning the first and second components 12 and 14 180 degrees away from each other. Thus, the backpack of the invention 10 enables efficient use of time and space.

Referring to FIG. 7, an exterior rear side of the panel 46 is configured to abut a user's back, and to be held in place by at least one adjustable strap 60. As shown in FIGS. 3-5 and 7, the backpack 10 may also be provided with a pair of adjustable straps 60. The pair of adjustable straps 60 may be attached to, for example, the panel 46 or at a junction between the panel 46 and the extension part 58 or the flexible member 50, as shown in FIG. 4. The exterior rear side of the panel 46 may be padded for added comfort and protection.

Referring to FIGS. 4-5 and 7, the backpack 10 may be provided with a strap 62 that can be used as a handle. Referring to FIG. 7, the strap 62 may be attached to the backpack 10 at the same locations as the straps 62 to simplify the construction and reduce manufacturing costs.

Referring to FIG. 7, a strap 64 can be attached to the exterior side of the panel 46 for securing the backpack 10 to additional external luggage (not shown). For example, the additional external luggage may have a telescopic handle in an expanded position, and the backpack 10 may be disposed on the additional external luggage to be supported (e.g., carried) by the additional external luggage. In this case, the telescopic handle of the additional external luggage may be disposed between the panel 46 and the strap 64, and the strap 64 may be sealed to the panel 64 to secure the backpack 10 to the additional external luggage.

Referring again to FIG. 7, the strap 64 may be attached to the backpack 10 at locations 68 and 70, and may have a resealable portion 66 approximately at mid-length. However, the location of the resealable portion 66 is not limited thereto. The resealable portion 66 may be, for example, a hook-and-loop fastener configured to attach the strap 64 to the panel 46. Thus, the backpack 10 can be attached to external luggage by, for example, inserting the telescoping handle of the additional external luggage between the panel 46 and strap 64, and by pressing the releasable portion 66 against the panel 46 to secure the backpack 10 to the luggage.

Figure 8:
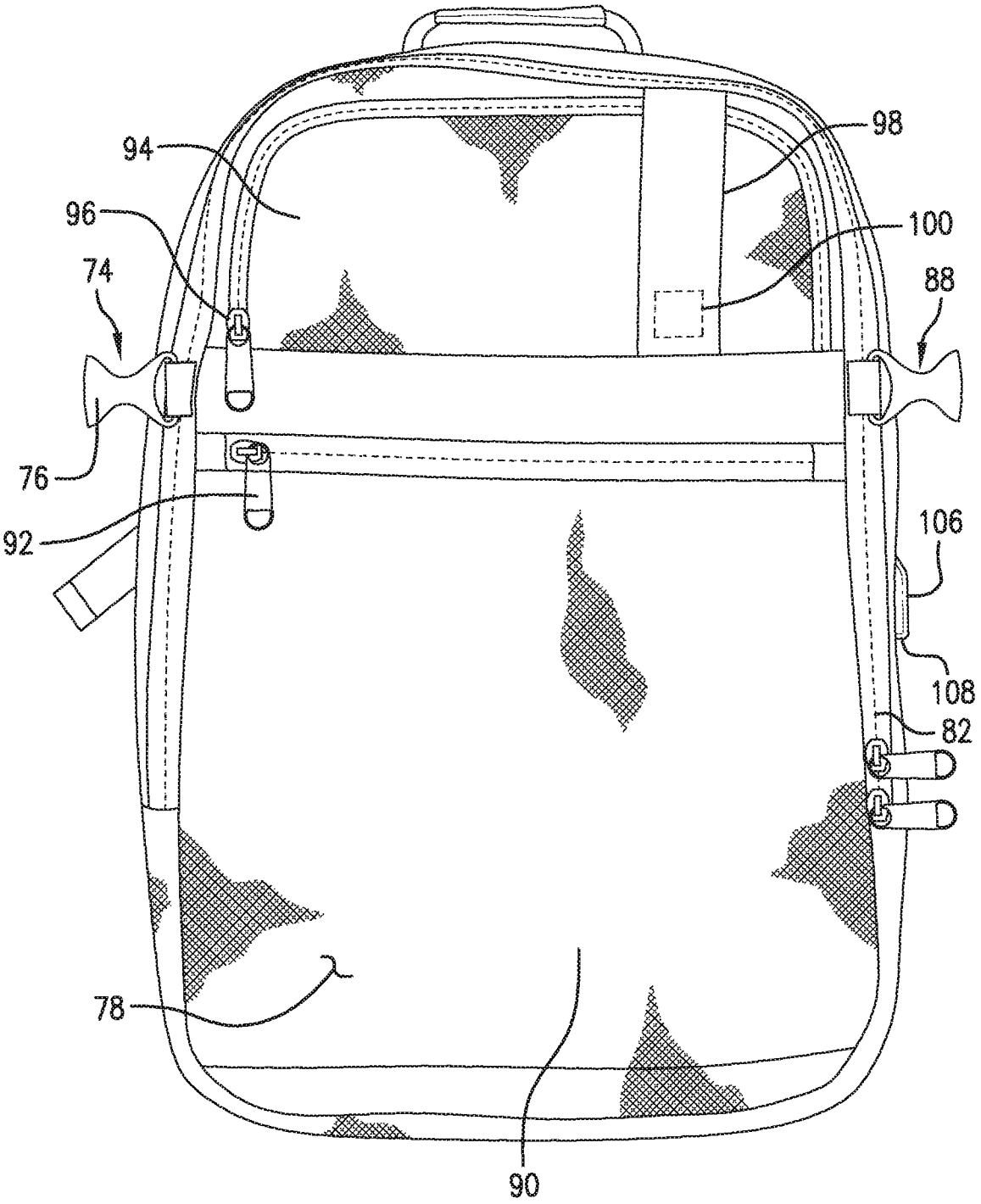
FIG. 8 is a front elevational view illustrating a front side of the backpack assembly of FIG. 1 in a closed state according to an exemplary embodiment of the present invention.

Referring to FIGS. 6 and 8, the first compartment 28 of the first component 12 of the backpack 10 may be defined by a panel 78 on its front, a panel 32 on its rear, and a member 80 linking the panels 32 and 78 all around. For example, the member 80 may extend between the panels 32 and 78, and may be connected all around an outer periphery of the panel 32 and all around an outer periphery of the panel 78.

Although not shown in the drawings, the member 80 may include a semi-rigid board on all sides of the first compartment 28 of the first component 12 when the first compartment 28 has sides (e.g., the backpack 10 has a polygonal shape, for example, a square shape, a rectangular shape, etc.), or a semi-rigid board on the outer periphery of the first compartment 28 when the first compartment 28 is round, oval, elliptical, etc., (e.g., the backpack 10 is round, oval, elliptical, etc.). The semi-rigid board(s) included in the member 80 may be flexible and can maintain its (their) own shape when resting on a surface and when loaded to a certain degree. Thus, the member 80 may provide a high degree of protection to the contents of the first compartment 28. In an embodiment, a degree of flexibility of the flexible members 50 and 36 is higher than a degree of flexibility of the member 80.

Referring to FIG. 8, the panel 78 may define a front face of the backpack 10, and may include one or more durable flexible fabric layers stacked on each other. The fabric layers of the panel 78 may include nylon, polyester, Kevlar, polyamide, and the like, may be woven, knit, etc., and may have perforations, a mesh-like structure, or a plain sheet structure. Alternatively, or in addition, the panel 78 may include leather, artificial leather, etc.

Referring to FIGS. 1, 4-6 and 8, the panel 78 may be selectively coupled to the member 80 by using a zipper 82. As shown in FIG. 1, a first web 84 and a second web 84 may be connected to the panel 78 and the member 80 at both ends of the zipper 82 to protect the junction between the panel 78 and the member 80 from being torn at or near the ends of the zipper 82. The first and second webs 84 may be made of a thin flexible material including include nylon, polyester, Kevlar, polyamide, leather, artificial leather, etc.

Figure 9:
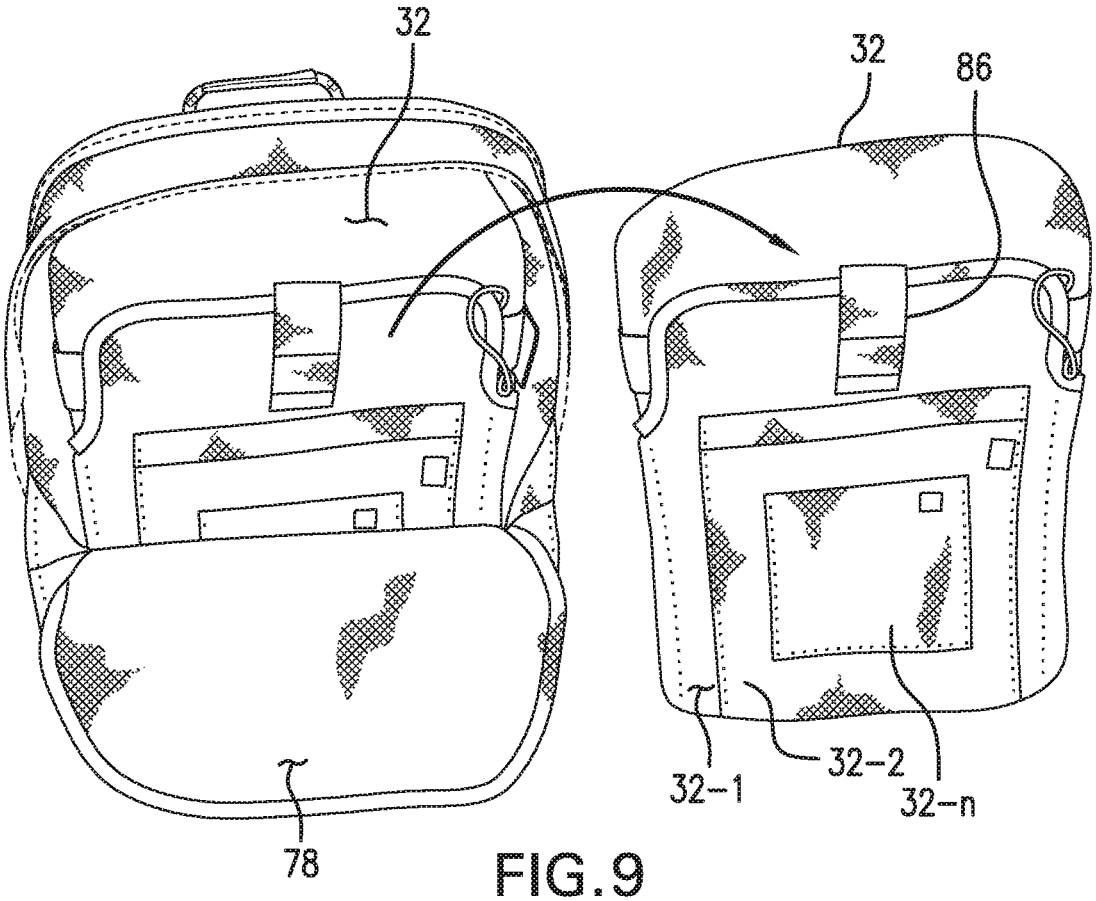
FIG. 9 is a plan view illustrating the front side of the backpack assembly of FIG. 1 in an open state according to an exemplary embodiment of the present invention.

FIG. 9 illustrates the configuration of the panel 32 inside of the first compartment 28 according to an exemplary embodiment. Referring to FIG. 9, a plurality of panels 32-1 to **32-*n* (where n is a positive integer greater than 1) may be attached to the panel 32 inside of the first compartment 28. The panels 32-1 to 32-*n* may be stacked on each other in the first compartment 28. Thus, the panel 32-1 may form a first storage area (e.g., a first pocket) with the panel 32 for storing portable electronics such as a laptop computer, a notebook personal computer (PC) etc. A panel 32-2 may form a second storage area (e.g., a second pocket) with the panel 32-1 for storing portable electronics such as a tablet, etc. The panel 32-*n* (n is 3 in the case of FIG. 9) may form a third storage area (e.g., a third pocket) with the panel 32-2 for storing a portable battery bank for charging various electronic devices, a smartphone, or other handheld devices. The first to third pockets may be stacked on each other and may be progressively smaller in size in a direction away from the panel 32, as shown in FIG. 9. Referring again to FIG. 9, an upper portion of the panel 32-1 may be connected to the panel 32 through a pair of flexible bands on the sides and a resealable strap 86** in the middle portion for securing the contents in the first storage area.

The entire first compartment 28 may be padded to protect the contents therein from shock, bumps, hits, smashes, etc. In addition, the panel 32-1 may be padded to further protect the items stored in the first storage area. Tags may be affixed onto the resealable strap 86 and the panels 32-2 to **32-*n*** to indicate the suggested use of the respective storage areas.

Referring to FIGS. 3 and 4, a first adjustable strap 74 may be used for securing the first and second components 12 and 14 secured to each other. As shown in FIG. 4, the first adjustable strap may include a first portion 74-1 connected to the first component 12 and a second portion 74-2 connected to the second component 14. For example, the first portion 74-1 may be connected to the panel 78 and the second portion 74-2 may be connected to the panel 46. However, the present invention is not limited thereto, and the first and second portions 74-1 and 74-2 may also be connected to a side of the backpack 10, for example, to the outer peripheries 80 and 50, respectively. The first and second portions 74-1 and 74-2 may be connected to each other through a quick-release buckle 76. The length of the first adjustable strap 74 may be adjusted through the quick-release buckle 76.

Referring to FIG. 5, a second adjustable strap 88 may be connected to a side of the backpack 10 opposite to the side in which the first adjustable strap 74 is connected. The second adjustable strap 88 may be used for securing the first and second components 12 and 14 to each other, and may have similar components and connection scheme as those of the first adjustable strap 74, as shown in FIG. 5. Thus, a detailed description thereof is being omitted for brevity purposes.

As shown in FIG. 3-4, a pocket 110, accessible by a zipper 104, may be included on a side of the backpack 10. A beverage holder 102 may be attached to an interior of the pocket 110. Opening the zipper 104 allows the beverage holder 102 to be protruded out of the pocket 110 to be used when needed. The beverage holder 102 may be made of a lightweight mesh-like material. The pocket 110 containing the beverage holder 102 may be included in a side of the backpack 10 corresponding to, for example, the member 80. However, the present invention is not limited thereto.

Referring to FIGS. 1 and 8, a port 106 for transferring data and for charging various electronic devices can be attached to a side of the backpack 10, for example, to a side corresponding to the member 80. The port 106 may be connected to a cable (not shown) in the interior of the backpack 10 (e.g., inside the first compartment 28), and the cable may be selectively connected to a rechargeable battery bank disposed in the backpack. Thus, the backpack 10 may be conveniently used to provide power to an external electronic device while remaining closed. The port 106 may include a universal serial bus (USB) receptacle, a USB type-C receptacle, etc.

Referring to FIG. 8, the port 106 may be covered by an insulating housing, the insulating housing having an opening 108 exposing the port 106. Thus, the port 106 may be protected from bumps, hits, shock, rain, snow, etc.

Referring to FIG. 8 again, an exterior side of the panel 78 forms the front side of the backpack 10. The panel 78 may include a first front pocket 90, accessible through a zipper 92, and a second front pocket 94, accessible through a zipper 96.

The zippers 18, 38, 52, 82, 92 and 96 may be water-resistant or water/rainproof.

In addition, all the zippers described in this specification may have one or two sliders for convenience.

As shown in FIG. 8, the second front pocket 94 may be secured by a resealable strap 98, having a resealable hook-and-loop fastener 100 for added protection of the contents therein. The exterior surfaces of the backpack 10 can be made waterproof for added weather protection. Although not shown in the drawings, the second front pocket 94 may be as large as approximately the entire panel 78. Thus, the first and second front pockets 90 and 94 may overlap with each other in the panel 78.

Thus, the backpack 10 of the present invention is a portable, lightweight and durable container adapted for daily use as well as for traveling. Its multitude of uses is readily apparent in light of the fact that the backpack 10 is configured to open like a book into two portions (the first and second components 12 and 14 which are pivotally connected to one another) to facilitate the storage and retrieval of items therefrom. Each of the two portions 12 and 14 is expandable on its respective sides for providing additional storage capacity when needed, and can be collapsed to a small width, for example, the width of its respective zipper, maintaining it collapsed for daily use. The backpack 10 may have a padded storage compartment for safely storing electronics and other sensitive/fragile items therein. Thus, other compartments of the backpack 10 may have adjustable sides made of lightweight, flexible and durable material that may omit padding to facilitate the expansion and collapsing of the sides of the backpack 10 and to maintain the weight of the backpack 10 low. In addition, the adjustable straps 74 and 88 on the sides of the backpack 10 reduce the tension forces acting on the adjustable sides of the backpack 10, further increasing the durability and longevity of the backpack 10.

While the present invention has been particularly shown and described with reference to exemplary embodiments thereof, it will be apparent to those of ordinary skill in the art that various changes in form and detail may be made therein without departing from the scope of the present invention.

What is claimed is:

1. A portable container, comprising:

a first storage component and a second storage component with each of the first and second storage components having a body with a plurality of sides for defining a periphery, wherein the first and second storage components are connected to each other along one of their sides such that they are pivotally rotatable with respect to one another;

a first elongated connector extending along at least a portion of the remaining sides of the first storage component; and a second elongated connector extending along at least a portion of the remaining sides of the second storage component and configured to be selectively matingly engaged with the first elongated connector, wherein at least one of the first and second storage components includes an adjustable storage space; wherein the first storage component includes a first panel having a plurality of sides for defining a periphery of the first panel, a second panel having a plurality of sides for defining a periphery of the second panel, and a flexible member connecting the plurality of sides of the first panel to the plurality of sides of the second panel; wherein the first panel, the second panel, and the flexible member define an adjustable storage space in the first storage component; and wherein the flexible member of the first storage component includes a plurality of sides configured to be collapsed or expanded between the first and second panels to adjust a distance between the first and second panels, thereby adjusting a carrying capacity of the adjustable storage space in the first storage component.

2. The portable container of claim 1, further comprising a third elongated connector extending along at least one of the sides of the first panel of the first storage component and a fourth elongated connector extending along at least one the sides of the second panel of the first storage component, wherein the fourth elongated connector is configured to be matingly engaged with the third elongated connector to adjust the carrying capacity of the adjustable storage space in the first storage component.

3. The portable container of claim 2, wherein the second storage component includes a first panel having a plurality of sides for defining a periphery of the first panel, a second panel having a plurality of sides for defining a periphery of the second panel, and a flexible member connecting the plurality of sides of the first panel to the plurality of sides of the second panel, the first panel, the second panel and the flexible member of the second storage component defining an adjustable storage space in the second storage component, wherein the flexible member of the second storage component includes a plurality of sides configured to be collapsed or expanded between the first and second panels of the second storage component to adjust a distance between the first and second panels, thereby adjusting a carrying capacity of the adjustable storage space in the second storage component.

4. The portable container of claim 3, further comprising a fifth elongated connector extending along at least one of the sides of the first panel of the second storage component and a sixth elongated connector extending along at least one of the sides of the second panel of the second storage component, wherein the sixth elongated connector is configured to be matingly engaged with the fifth elongated connector to adjust the carrying capacity of the adjustable storage space in the second storage component.

5. The portable container of claim 4, wherein the first storage component further includes a second storage space separated from the adjustable storage space and disposed adjacent to the adjustable storage space of the first storage component, and a third panel of the first storage component defining a side of the second storage space, wherein the first panel of the first storage component is configured to provide access to the adjustable storage space of the first storage component and the third panel is configured to provide access to the second storage space of the first storage component.

6. The portable container of claim 5, wherein the first and third panels of the first storage component are disposed at opposite ends of the first storage component.

7. The portable container of claim 6, wherein the first panel of the second storage component is configured to provide access to the adjustable storage space in the second storage component.

8. The portable container of claim 7, wherein the first panel of the first storage component and the first panel of the second storage component face one another when the first and second elongated connectors are engaged with each other.

9. The portable container of claim 5, wherein the second storage space is padded.

10. The portable container of claim 5, wherein the flexible member of at least one of the first and second storage components is unpadded.

11. The portable container of claim 5, wherein the flexible member of at least one of the first and second storage components includes nylon, polyester, Kevlar, polyamide, leather or vinyl.

12. The portable container of claim 5, further comprising a universal serial bus (USB) or USB type-C port attached to an exterior side of the second storage space and a cable connected to the port from inside of the second storage space.

13. The portable container of claim 5, further comprising at least one adjustable strap attached to an exterior side of the second panel of the second storage component for carrying the portable container, wherein the first and second panels of the second storage component are disposed at opposite ends of the second storage component.

14. The portable container of claim 1, further comprising a first adjustable strap connected to the first and second storage components at a first side of the portable container and a second adjustable strap connected to the first and second storage components at a second side of the portable container for securing the first and second storage components to each other.

15. The portable container of claim 1, further comprising a resealable pocket disposed on an exterior side of the first storage component and a flexible beverage holder attached to an interior of the resealable pocket, wherein the flexible beverage holder is configured to be selectively stored in the resealable pocket or projected outside of the resealable pocket.

16. The portable container of claim 5, wherein the first and third elongated connectors are disposed adjacent to each other without a gap therebetween, or the second and fifth elongated connectors are disposed adjacent to each other without a gap therebetween.

17. A backpack, comprising:

a first storage component including a first storage compartment having a volume and a second storage compartment having a volume, wherein the first storage compartment includes a first panel, a second panel and a first flexible member extending between the first and second panels and defined by one or more sides, wherein the first flexible member connects the first panel to the second panel to selectively adjust the volume of the first storage compartment by collapsing or expanding the one or more sides, wherein the second storage compartment includes a third panel, the second panel being disposed between the first and third panels, and wherein the first and third panels are respectively configured to provide access to the first and second storage compartments;

a second storage component including a fourth panel, a fifth panel and a second flexible member extending between the fourth and fifth panels and defined by one or more sides, wherein the second flexible member connects the fourth panel to the fifth panel to selectively adjust the volume of the second storage component by collapsing or expanding the one or more sides, wherein the fourth panel is configured to provide access to the second storage component;

a flexible connecting member connected between the first storage component and the second storage component to pivotally connect the first and second storage components to each other;

a first elongated connector extending along at least a portion of the first panel of the first storage component;

a second elongated connector extending along at least a portion of the second storage component and configured to be selectively coupled to the first elongated connector, the first and second elongated connectors being configured to selectively couple the first and second storage components to each other;

a third elongated connector extending along one of the first flexible member and the first panel;

a fourth elongated connector extending along one of the first flexible member and the second panel and configured to be selectively coupled to the third elongated connector for maintaining the first flexible member collapsed or to be selectively uncoupled from the third elongated connector for allowing the first flexible member to be expanded;

a fifth elongated connector extending along one of the second flexible member and the fourth panel; and a sixth elongated connector extending along one of the second flexible member and the fifth panel and configured to be selectively coupled to the fifth elongated connector for maintaining of the second flexible member collapsed or to be selectively uncoupled from the fifth elongated connector for allowing the second flexible member to be expanded.

18. The backpack of claim 17, wherein the first and second elongated connectors are components of a first zipper, the third and fourth elongated connectors are components of a second zipper and the fifth and sixth elongated connectors are components of a third zipper.

19. The backpack of claim 18, wherein the first zipper includes a pair of sliders.

* * * * *